United States Patent [19]

Desai

[11] 4,452,027

[45] Jun. 5, 1984

[54] PANEL CLIP

[75] Inventor: Rajendra K. Desai, Troy, Mich.

[73] Assignee: Whitehead & Kales Company, River Rouge, Mich.

[21] Appl. No.: 306,195

[22] Filed: Sep. 28, 1981

[51] Int. Cl.[3] ..... E04B 1/38

[52] U.S. Cl. ..... 52/712; 52/463

[58] Field of Search ..... 52/713, 461, 715, 712, 52/770, 777, 46, 55, 56, 57, 49, 463, 94

[56] References Cited

U.S. PATENT DOCUMENTS 1,093,201 4/1914 Owen ..... 52/46

1,328,200 1/1920 Reeder ..... 52/49

3,469,360 9/1969 Peterson ..... 52/665

*Primary Examiner*—John E. Murtagh

*Assistant Examiner*—Kathryn L. Ford

*Attorney, Agent, or Firm*—Barnes, Kisselle, Raisch, Choate, Whittemore & Hulbert

[57] ABSTRACT

A panel clip for holding the side paneling of a rail car in place having a central channel-shaped portion the side walls of which at their extremities are bent laterally outwardly in opposite directions to provide coplanar flange portions. An integral tab is bent up from each flange portion at a right angle to the plane thereof.

2 Claims, 7 Drawing Figures

FIG. 1
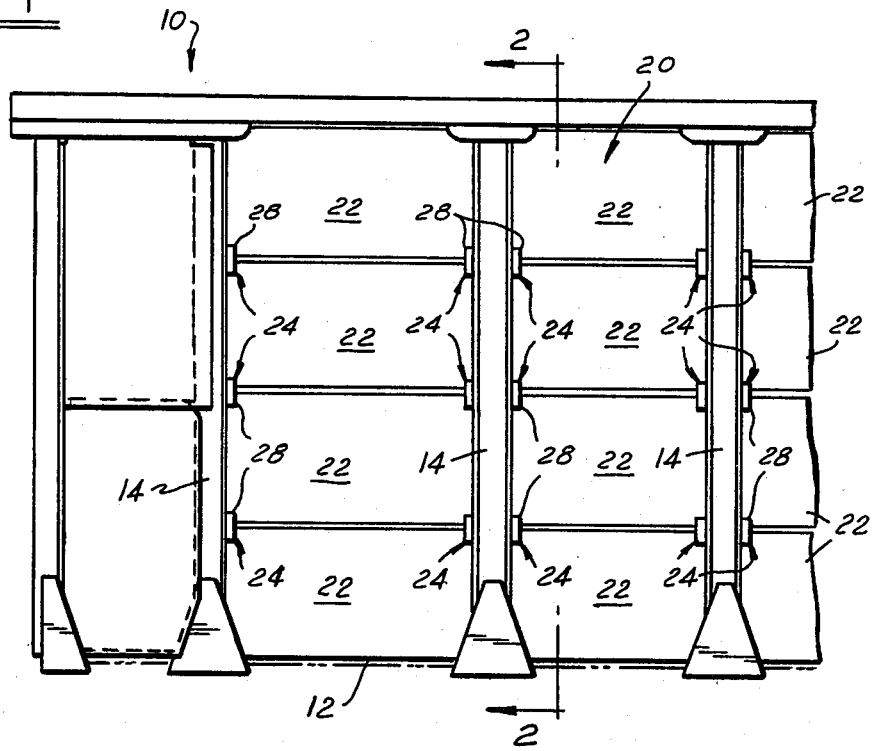
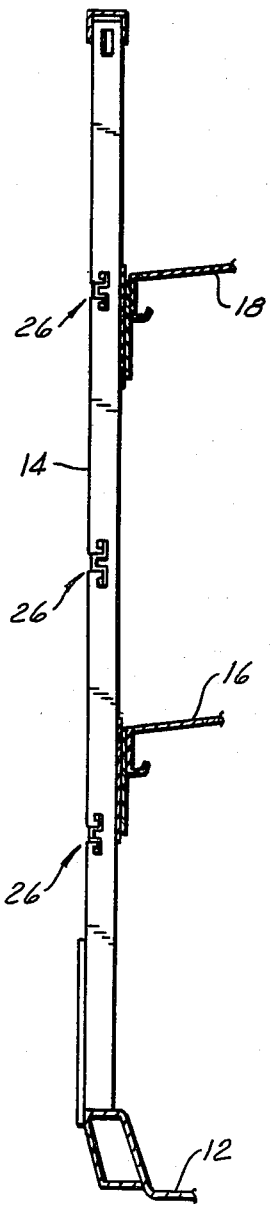
FIG. 2
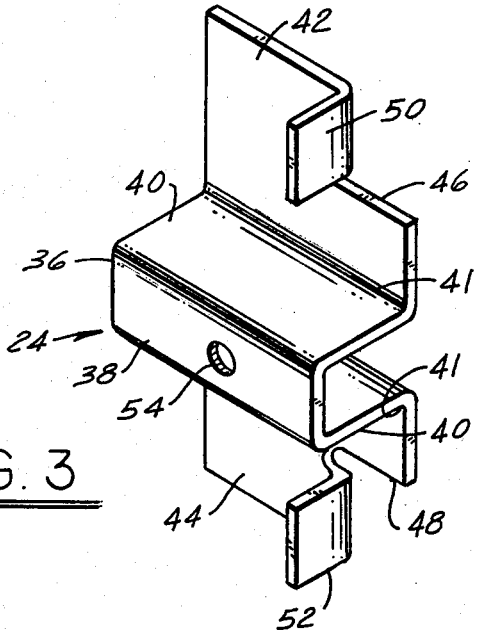
FIG. 3

FIG. 4
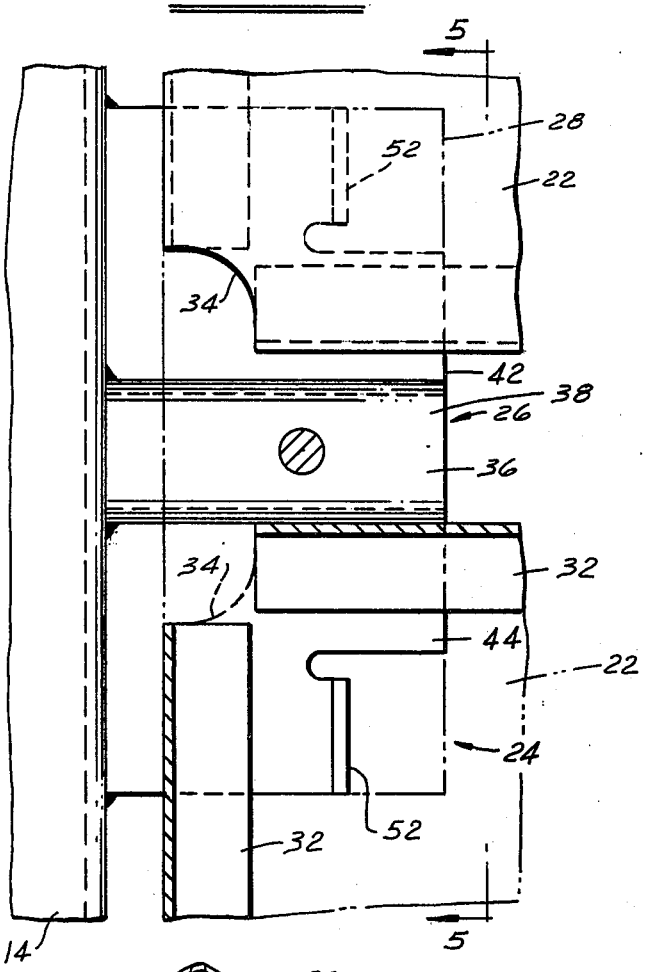
FIG. 5
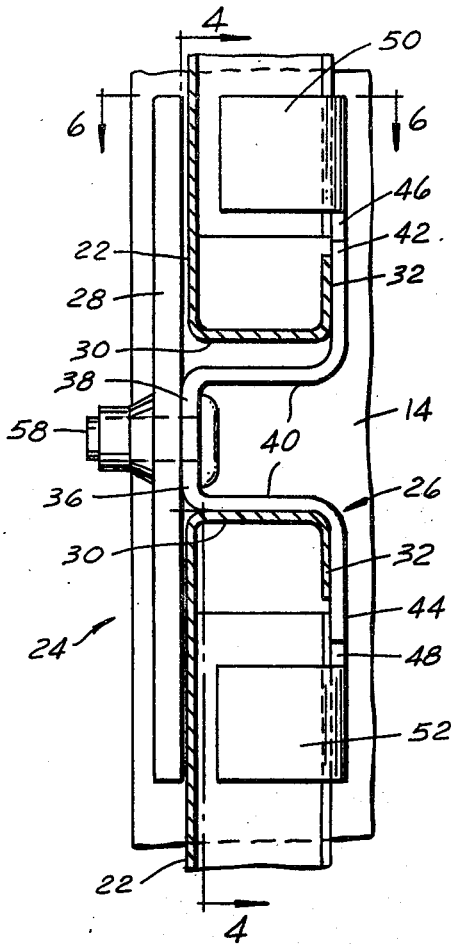
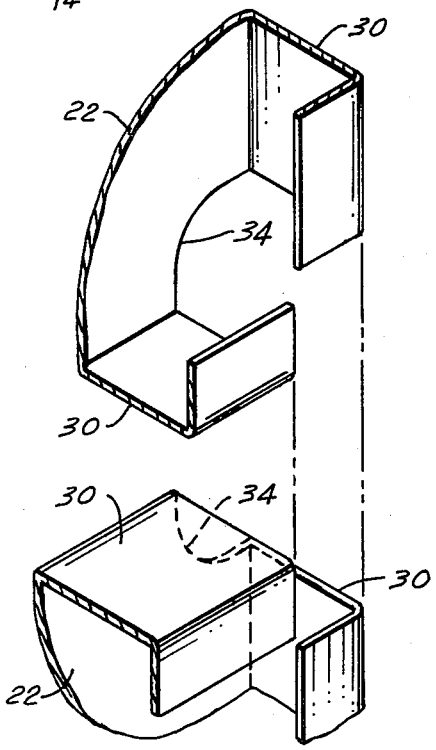
FIG. 7
FIG. 6
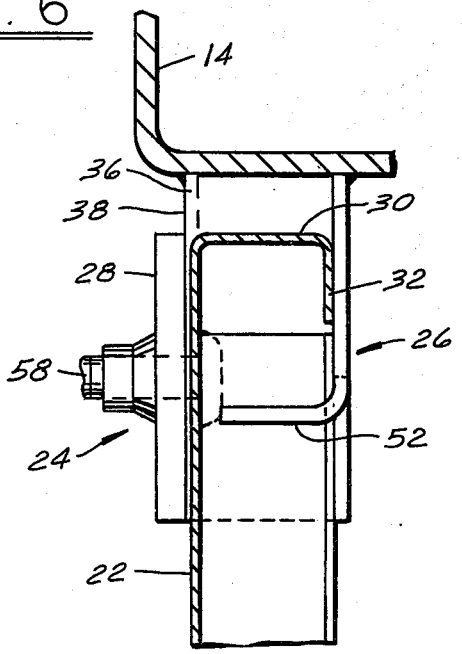

PANEL CLIP

This invention relates generally to a clip and refers more particularly to a panel clip for holding the side paneling of a rail car in place.

BACKGROUND AND SUMMARY OF THE INVENTION

Panels closing the sides of a rail car are often held by corner brackets. However, such panels can be pulled out of their corner entrapment by a vandal or thief. It is a primary object of this invention to provide a bracket or clip which will overcome this problem.

The panel clip of the present invention which is about to be described has a central portion, flange portions extending in opposite directions from the central portion, and a tab projecting from each flange portion.

More specifically, the embodiment described hereinafter is formed from a single plate having a central channel-shaped portion the side walls of which extend down from the web thereof and at their extremities are bent laterally outwardly in opposite directions to provide coplanar flange portions, and an integral tab bent up from each flange portion and projecting at a substantial angle to the plane thereof.

Other objects and features of the invention will become more apparent as the following description proceeds, especially when considered with the accompanying drawings.

BRIEF DESCRIPTION OF THE DRAWINGS

FIG. 1 is a side elevational view of a portion of a rail car.

FIG. 2 is a sectional view taken on line 2—2 in FIG. 1.

FIG. 3 is a detail view in perspective of a panel clip constructed in accordance with the invention and used on the rail car as a means of securing the side paneling in place.

FIG. 4 is an enlarged fragmentary view partly in section of a portion of FIG. 1 and taken on the line 4—4 in FIG. 5, as seen from the outer side of the car.

FIG. 5 is a sectional view taken along the line 5—5 in FIG. 4.

FIG. 6 is a sectional view taken on the line 6—6 in FIG. 5.

FIG. 7 is a view of the corner portions of two panels in the positions they would assume when held by a single panel clip.

DETAILED DESCRIPTION

Referring now more particularly to the drawings, the transport vehicle shown in FIG. 1 is a railroad flat car 10 which would be supported on the usual wheels and which has an elongated generally horizontal lower deck or bed structure 12 extending lengthwise of the car. Side frame structure for the car comprises a plurality of vertical uprights or posts 14 which rise from the lower deck or bed structure 12 in two rows extending lengthwise of the railroad flat car along both sides thereof. As shown, the posts 14 in each row are spaced apart lengthwise of the rail car.

The rail car 10 may be of various different constructions but in the present instance is shown as having a generally horizontal middle deck 16 extending lengthwise of the car which is spaced above the lower deck or bed structure 12, and a generally horizontal upper deck 18 extending lengthwise of the rail car which is spaced above the middle deck 16. A rail car of this type may, for example, be used to transport automotive vehicles on the three decks. The opposite longitudinal edge portions of the middle and upper decks 16 and 18 may be rigidly secured to the posts.

In order to protect the vehicles or other contents being transported by the rail car, a side panel installation 20 is provided for each side of the rail car to close the open spaces between the posts. Each side panel installation includes a plurality of panels 22. As seen in FIG. 1, the panels are arranged in vertical rows between adjacent posts and are generally rectangular in configuration. They are held at the corners by bracket structure 24, each including a panel clip 26 and a clamping plate 28.

The panels 22 in this instance are in the form of flat rectangular sheets, each of the four edges of which are bent 90° away from the plane of the sheet where indicated at 30 and then return bent to provide flanges 32 parallel to the plane of the sheet. The four corners of each panel are cut out at 34 to provide clearance between the ends of the terminal flanges at adjacent corners.

Each panel clip 26 is formed from a single initially flat rectangular metal plate into the configuration shown in FIG. 3. The panel clip has a central channel-shaped portion 36 consisting of a web 38 and laterally spaced parallel side walls 40 extending down from the web of the channel at right angles thereto. At their extremities the side walls are bent laterally outwardly along parallel lines 41 to provide coplanar flange portions 42 and 44 parallel to the web of the channel. The flange portions are formed with parallel slots 46 and 48 which extend parallel to the bend lines 41. The portions of the flange portions outwardly of the slots are bent up along lines perpendicular to bend lines 41 to provide integral tabs 50 and 52. The tabs are disposed in a common plane perpendicular to the side walls 40 and the flange portions 42 and 44. The upper extremities of the tabs terminate short of the plane of the web 38 of the channel-shaped portion 36. The web of the channel-shaped portion has a central hole 54.

These panel clips are rigidly secured to the confronting surfaces of the posts 14 in the manner shown in the drawings, that is, with the flange portions 42 and 44 extending vertically and with the channel-shaped portion 36 disposed laterally outwardly of the flange portions and extending horizontally in a direction lengthwise of the rail car. The panel clips are permanently secured to the posts as by welding, in locations such that the flange portions 42 and 44 overlap the corners of adjacent panels. As seen in FIGS. 4–6, the panels have their marginal edges turned laterally inwardly with respect to the rail car and are supported by the clips with their terminal flanges 32 engaging the flange portions 42 and 44 of the clips and the tabs 50 and 52 extending toward the inner surface of the panel close to the terminal flanges. A rectangular clamping plate 28 is secured to the web of the channel-shaped portion 36 of each panel clip as by means of a two piece rivet assembly 58 which extends over the outer surface of the corner portions of each of two panels in substantially surface-to-surface engagement therewith. The panels are constrained against movement vertically by the channel-shaped portions 36 of the clips and against movement horizontally by the posts 14.

The panels are each held at the four corners in the manner shown in FIGS. 4–6. A thief may try to flex a panel enough so that it pulls away from the bracket structure 24 and escape its corner entrapment. This is prevented, however, by the tabs 50 and 52 which engage the terminal flanges 32 of the panels before they can shift far enough to pull out of the bracket structure 24.

The upper corners of the top tier of panels and the lower corners of the bottom tier of panels may be held by the same bracket structure 24 herein described, although concealed by the post structure in FIG. 1.

I claim:

1. Bracket structure adapted to hold a panel in place on the side of a rail car, said bracket structure comprising a corner panel clip formed from a plate of integral one-piece construction and having a central channel-shaped portion of the side walls of which extend down from the web thereof and at their extremities are bent laterally outwardly in opposite directions to provide coplanar flange portions, and an integral tab bent up from each flange portion at a substantial angle to the plane thereof, said tabs terminating at a level beneath that of the web of said channel-shaped portion, and a clamping plate removably secured to the web of the channel-shaped portion of said panel clip and overlying the upper extremities of said tabs in spaced relation thereto sufficient to provide enough clearance to accommodate a panel.

2. Bracket structure as defined in claim 1, wherein said flange portions each have a slot extending from one edge thereof generally parallel to said channel-shaped portion, and said tabs are formed by bending up the part of said flange portions outwardly of said slots.

* * * * *